United States Patent [19]

Wells

[11] 4,449,439

[45] May 22, 1984

[54] MOUTHPIECE FOR WOODWIND INSTRUMENTS

[76] Inventor: Frank E. Wells, 14514 Wallace Ave., Riverdale, Ill. 60627

[21] Appl. No.: 425,720

[22] Filed: Sep. 28, 1982

[51] Int. Cl.[3] ..... G10D 9/02

[52] U.S. Cl. ..... 84/383 R

[58] Field of Search ..... 84/383 R

[56] References Cited

U.S. PATENT DOCUMENTS

| | | | |
|---|---|---|---|
| 1,413,929 | 4/1922 | Naujoks et al. | 84/383 R |
| 1,696,516 | 12/1928 | Bercioux | 84/383 R |
| 2,494,231 | 1/1950 | Dunn | 84/383 R |
| 2,525,523 | 10/1950 | Chance | 84/383 R |

FOREIGN PATENT DOCUMENTS

| | | | |
|---|---|---|---|
| 593340 | 2/1934 | Fed. Rep. of Germany | 84/383 R |
| 424861 | 5/1911 | France | 84/383 R |
| 603056 | 4/1926 | France | 84/383 R |
| 655634 | 4/1929 | France | 84/383 R |

*Primary Examiner*—Lawrence R. Franklin
*Attorney, Agent, or Firm*—Basil E. Demeur

[57] ABSTRACT

There is disclosed an improved mouthpiece intended for woodwind instruments such as clarinets and saxophones, of the type generally known, which further includes as an improvement a key-shaped slotted cut-out section formed along the horizontally flattened portion thereof, the key-shaped slotted cut-out section formed by a pair of opposed curvilinear flanges formed along the opposed side edges of the slotted cut-out section, the curvilinear flanges having a sufficient thickness such as to reduce the overall diameter of the wind channel by between 25% and 50% thereof, thereby to create a wind compression chamber adjacent to the tip end of the mouthpiece along the path of the wind channel thereby to function to smooth out the vibrational air pulses as the same travel through the mouthpiece and into the instrument in order to improve the tonal qualities of the instrument throughout the entire tonal range of the instrument.

5 Claims, 6 Drawing Figures

MOUTHPIECE FOR WOODWIND INSTRUMENTS

BACKGROUND OF THE INVENTION

It is well known to those skilled in the art of musical instruments that virtually all musical instruments, including brass instruments as well as woodwind instruments, require a mouthpiece which is usually removably mounted onto the instrument incident to the playing thereof. It is further well known that the tonal qualities and characteristics of any instrument are integrally dependent upon the shape, construction, and configuration of the mouthpiece, regardless of the type of instrument involved.

This is especially true in connection with woodwind instruments, wherein the mouthpiece is designed to accommodate a wood reed which is removably mounted to the mouthpiece, since the tonal characteristics of the instrument will then be directly dependent not only upon the construction of the mouthpiece, but also the quality and character of the reed affixed thereto. In this connection, specific reference is made to instruments such as clarinets and saxophones. The typical mouthpiece for such instruments is constructed in the form of a unitary element which includes a collar end for engaging the instrument neck, which is usually fitted with a cork barrel such that the instrument may be frictionally engaged thereon. The opposed end of the mouthpiece includes a mouth biting portion which is constructed to have an inclined surface along the top portion thereof, and a horizontally flattened surface along the lower portion thereof. The horizontally flattened lower surface is designed to accommodate the reed thereon which is maintained in position, typically, by a metal screw collar. The mouthpiece is hollow throughout, such that a wind channel is created traversing the entire barrel of the mouthpiece. The lower horizontally flattened surface of the mouthpiece further includes a slot which is cut out therein and which extends from the tip end of the mouthpiece inwardly for a distance in the direction of the collar end of mouthpiece. Typically, the slotted cut-out section is bounded by opposed side edges which extend from the tip end of the mouthpiece on a slight angle inwardly to a rounded intersection, and traverses approximately no greater than between 30% and 35% of the overall length of the mouthpiece.

It is known that the manner in which a woodwind instrument such as a clarinet or saxophone will produce certain tonal characteristics relates to the fact that the instrument itself contains a column of air internally of the instrument. The length of the column of air in the instrument is varied by the operator opening or closing various of the keys located on the instrument. Hence, different tones along the scale may be produced thereby. When the operator plays the instrument, air is forced through the mouthpiece into the instrument thereby affecting the air column contained therein. It is further known that air will pass into the mouthpiece from the operator's mouth in vibrating fashion, or in other words, as the operator blows into the instrument, air enters through the reed in a vibrational form. In some ranges of the instrument, for example, air will pass into the instrument at the rate of 440 puffs of air per second. It is further known that the reason for the construction and configuration of the wind channel in the mouthpiece is to control and direct the air vibrations as they pass into the instrument in order to produce the tonal sounds from the instrument. In this connection, it is known that at the high end of the tone range, a relatively small amount of air is necessary to pass through the reed since the reed need only vibrate a small amount in order to formulate the note. At the lower end of the tone register, substantially more air is necessary, since the reed will vibrate at a much slower rate in order to create the note. Therefore, it is known that each note will be sounded based upon the number of vibrations of the reed per second of time. It is further known that as one increases the octave on the instrument, that is, moves to a higher octave, the vibration rate necessary for the reed is doubled for each octave.

It has been found, however, that it is extremely difficult to design a mouthpiece, especially for a wood wind instrument, which permits the operator to have full and brilliant tone qualities at both the low end and the high end of the tonal register of the instrument. In short, when the operator changes his embouchure and the velocity of the wind entering the instrument in order to move from lower to higher registers in the tone and note range, it is difficult for the wind channel in the mouthpiece to accommodate the changes in wind velocity traversing the mouthpiece and entering into the instrument, while still maintaining a steady flow of air into the instrument such that the column of air maintained in the instrument will not be violently disturbed. As indicated previously, if the air column contained within the instrument receives a series of severe vibrational pulses, the column is disrupted, and this has the tendency to distort the tonal characteristics of each of the notes as they are played.

OBJECTS AND ADVANTAGES

It is therefore the principal object of the present invention to provide an improved mouthpiece construction especially adapted for a woodwind instrument, which is constructed to include a wind compression chamber formed in the wind channel which has the effect of smoothing out the air vibrational pulses as the same travel through the mouthpiece and into the instrument thereby to eliminate any sudden or violent air vibrational forces from disrupting the column of air located in the instrument.

Another object of the present invention is to provide an improved mouthpiece for a woodwind instrument which further includes a slotted cut-out section bounded by opposed side edges formed in the horizontally flattened portion of the mouthpiece along the lower portion thereof, the slotted cut-out section extending from the tip end of the mouthpiece inwardly for a distance in the direction of the collar end and terminating in a circular inner end, the slotted cut-out section having key slot configuration formed by a pair of opposed curvilinear flanges extending inwardly from the opposed side edges thereof for a portion of the distance between the tip end and the circular inner end, the curvilinear flanges having a thickness which is less than the diameter of the wind channel thereby to create a wind compression chamber formed in the wind channel and extending for a distance along the wind channel.

In conjunction with the foregoing object, it is a further object of the invention to provide a woodwind mouthpiece of the type described wherein the slotted cut-out section has a length which extends from the tip end of the mouthpiece inwardly for approximately 40% or less of the overall length of the mouthpiece.

In conjunction with the foregoing objects, it is still a further object of the invention to provide an improved mouthpiece of the type described wherein the curvilinear flanges have a thickness sufficient to reduce the overall diameter of the wind channel by between 25% and 50% thereof and extend for a distance of approximately 60% of the length of the slotted cut-out section inwardly from the tip end of the mouthpiece.

Still a further object of the invention is to provide an improved woodwind mouthpiece of the type described, wherein the inclined surface forming the top portion of the mouthpiece includes an undersurface which forms the roof of the wind channel of the mouthpiece, the roof having a thickened portion extending over the curvilinear flanges, which together create a wind compression chamber which has a diameter of the between 25% and 50% less than the diameter of the wind channel.

Further features of the invention pertain to the particular arrangement of the elements and parts whereby the above-outlined and additional operating features are attained.

The invention, both as to its organization and method of operation, together with further object and advantages thereof will best be understood by reference to the following specification, taken in connection with the accompanying drawings.

SUMMARY OF THE INVENTION

In summary, the present invention provides an improved mouthpiece for a woodwind instrument wherein the mouthpiece, which typically includes a collar end for engaging an instrument neck at one end, and a mouth engaging portion at the opposed end thereof extending from the tip end inwardly for a distance in the direction of the collar end, the mouth engaging portion having an upper inclined surface along the top portion thereof and a horizontally flattened surface along the lower portion thereof for supporting a reed thereon, and a wind channel traversing the entire length of the mouthpiece, the improvement being formed by a slotted cut-out section bounded by opposed side edges formed in the horizontally flattened surface along the lower portion thereof, the slotted cut-out section extending from the tip end of the mouthpiece inwardly for a distance in the direction of the collar end and terminating in a circular inner end, and the slotted cut-out section having a key slot configuration formed by a pair of opposed curvilinear flanges extending inwardly from the opposed side edges of the slotted cut-out section for a portion of the distance between the tip end and the circular inner end, and the curvilinear flanges having a thickness sufficient to reduce the diameter of the wind channel for a portion along the length thereof thereby to create a wind compression chamber within the wind channel in order to regulate the vibrational pulse rate of air as it traverses the mouthpiece. The configuration of the structure of the mouthpiece as set forth above, as indicated, will create a wind compression area in a portion of the mouthpiece adjacent to the tip end, and has the effect of smoothing out the vibrational pulses of air as the same are forced through the mouthpiece and into the instrument, with the concomitant result that the column of air maintained in the instrument will only be imperceptibly disturbed as the air impulses travel into the instrument for the purpose of creating the notes and the tonal qualities of each of the notes played by the operator. The result of the construction is to the effect that the operator is permitted to create bright and brilliant tones at both the low end of the register of the instrument as well as the upper register of the instrument thereby to improve the overall tonal characteristics of the instrument when played.

DETAILED DESCRIPTION OF DRAWINGS

Figure 1:
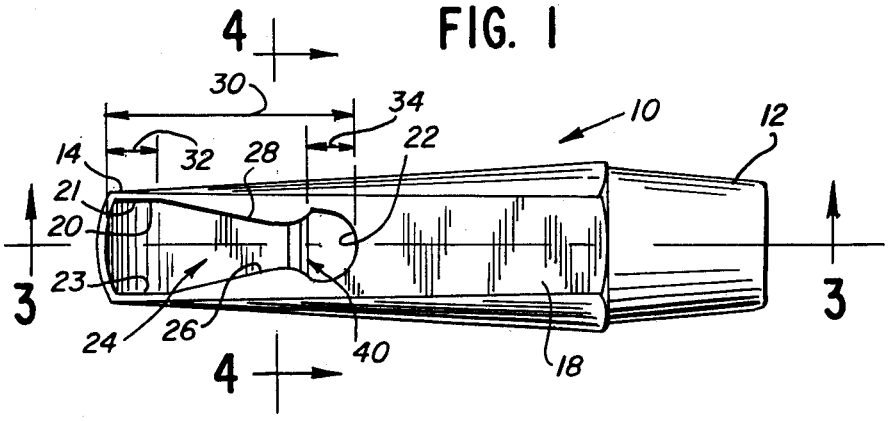
FIG. 1 is a side elevational view showing the bottom portion of the improved mouthpiece of the present invention including the slotted cut-out section formed in the configuration of a key slot in accordance with the teachings of the present invention.
Figure 2:
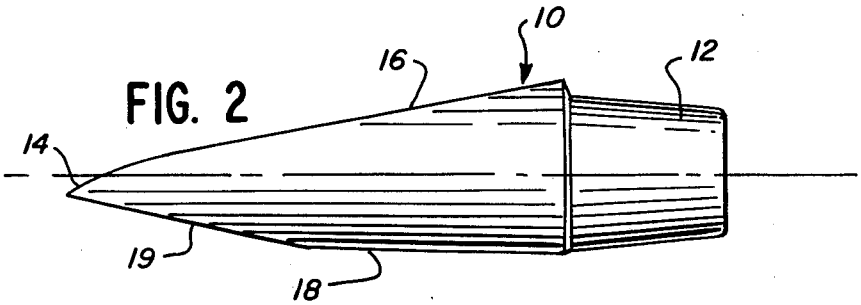
FIG. 2 is side elevational view of the entire mouthpiece showing the configuration of the mouthpiece from tip end to collar end and showing the inclined top surface thereof.

With specific reference to FIG. 1 of the drawings, the mouthpiece 10 is generally indicated. It will be observed that the mouthpiece 10 includes a collar end 12 which is intended to frictionally engage the neck of an instrument, such as a clarinet or saxophone. The opposed end of the mouthpiece 10 includes the tip end 14 which is intended to be the mouth engaging end of the mouthpiece 10. The mouthpiece 10 is further shown to include an inclining portion formed along the top surface of the mouthpiece, generally indicated by the numeral 16 (FIG. 2), and a horizontally flattened portion along the lower surface of the mouthpiece 10, generally indicated by the numeral 18. It will be noted that the horizontally flattened portion 18 includes an inclined section 19 adjacent to tip end 14 which functions in the typical manner for facilitating the mouth engaging function of the mouthpiece.

Again with reference to FIG. 1, there is shown a slotted cut-out section 20 which extends from the tip end 14 inwardly toward the collar end 12 for a distance, and terminating in a circular inner end 22. It is well known in the art that the typical slotted cut-out section of a mouthpiece 10 includes substantially parallel side edges which extend from the tip end 14 and terminating in a circular end 22. However, as illustrated in FIG. 1 of the drawings, the slotted cut-out section 20 is shown to be formed in the configuration of a key slot, generally indicated by the numeral 24, the key slot configuration 24 being formed by a pair of opposed curvilinear flanges 26 and 28 respectively. It will be observed that the curvilinear flanges 26 and 28 are carried along the side edges 21 and 23 respectively of the slotted cut-out section 20.

It is also known that in a typical woodwind mouthpiece, the slotted cut-out section has an overall length measured from the tip end 14 to the inner circular end 22 which is approximately 40% or less of the overall length of the mouthpiece, as measured from tip end 14 to the collar end 12. It has been found that the ideal length for the curvilinear flanges 26 and 28 is such that the flanges 26 and 28 account for only approximately 60% of the overall length of the slotted cut-out section 20.

In addition, it has been determined that it is preferable to commence the curvilinear flanges 26 and 28 at a point approximately inwardly from the tip end 14 of the mouthpiece 10 a distance of 1/6th of the overall length of the slotted cut-out section, and to terminate the curvilinear flanges 26 and 28 at a point, again a distance of approximately 1/6th of the overall length of the slotted cut-out section 20. With reference to FIG. 1 of the drawings, if the overall length of the slotted cut-out section is denoted by the numeral 30, the curvilinear flanges 26 and 28 respectively will commence at a distance 32 as measured from the tip end 14 of the mouthpiece 10, and at the opposed end thereof, will terminate at a distance 34 as measured inwardly from the circular inner end 22 of the mouthpiece 10. It has been found that the distances denoted by the numerals 32 and 34 are each approximately 1/6th of the overall length of the distance denoted by the numeral 30.

Figure 3:
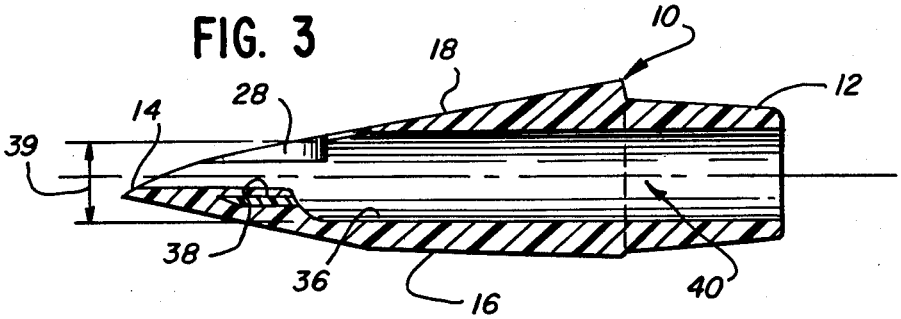
FIG. 3 is a side elevational view, in cross section, taken in the direction of the arrows along the line 3—3 of FIG. 1, which further illustrates the relationship between the curvilinear flanges, and the thickened portion of the roof of the wind channel which together cooperate to form a wind compression chamber in the wind channel.
Figure 4:
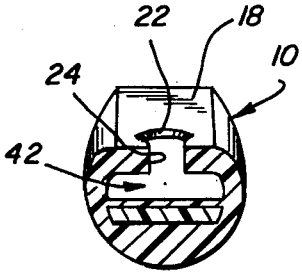
FIG. 4 is a front elevational view, in cross section, taken in the direction of the arrows along the line 4—4 of FIG. 1, illustrating the relationship between the thickened portion of the roof of the wind channel, and the configuration of the curvilinear flanges in combination therewith to create the wind compression chamber shown therein.
Figure 6:
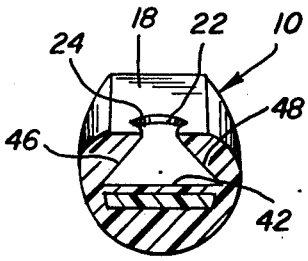
FIG. 6 is a front elevational view, in cross section, showing an alternate embodiment of the configuration of the curvilinear flanged area wherein the flanges are configured in the nature of gussets to create a smooth walled wind compression chamber formed in the wind channel.
Figure 5:
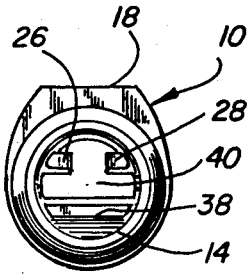
FIG. 5 is a rear elevational view showing the details of construction of the wind channel, including the thickened portion of the roof of the mouthpiece, as well as the positioning of the curvilinear flanges therein, and illustrating the method of formation of the wind compression chamber therein.

It will also be observed with reference to FIGS. 1 and 3 of the drawings, that the internal confines of the mouthpiece 10 include a wind channel 40 which traverses the entire length of the mouthpiece 10, from tip end 14 to the collar end 12. It is known that wind channel 40 is the passage way through which air is forced into the mouthpiece 10 and the instrument (not shown) by the operator thereof, and plays an important role in the manner in which the pitch and tone characteristics of the notes are achieved by the operator. As shown in FIGS. 3, 4 and 6 of the drawings, the inclined portion 16 formed along the top portion of the mouthpiece 10 has an undersurface 36 which forms the internal confines of the wind channel 40. With specific reference to FIG. 3 of the drawings, it will be observed that the improved mouthpiece 10 of the present invention further includes a thickened portion 38 which is positioned to lie immediately above the positioning of the curvilinear flanges 26 and 28 respectively. It will be appreciated from a view of FIGS. 3 and 4 of the drawings, that the thickened portion 38, when taken in conjunction with the curvilinear flanges 26 and 28, will reduce the overall diameter 39 of the wind channel 40 by a distance equivalent to the thickness of the curvilinear flanges 26 and 28 as well as the thickness of the thickened portion 38. As shown in FIG. 4 of the drawings, by providing the curvilinear flanges 26 and 28 in conjunction with the thickened portion 38, a wind compression chamber 42 is created along the path of the wind channel 40, and at a point immediately adjacent to the tip end 14 of the mouthpiece 10.

As was indicated previously, it has been found that when the operator of the instrument blows into the mouthpiece, air is forced through the mouthpiece and into the instrument to which the mouthpiece is attached. However, air does not pass in a steady stream, but rather, is forced into the mouthpiece 10 in a pulsating manner. Indeed, it has been found that in some ranges of the instrument, the vibrational pulse rate of the air blown by the operator into the mouthpiece 10 can be as much 440 pulses per second. Further, as was previously indicated, an instrument normally carries a column of air in the tubular portion of the instrument, the column of air being varied in length by the operator during the playing of the instrument by depressing keys along the length of the tube of the instrument. It is in this manner that various notes are created incident to the playing of the instrument. The tonal characteristics and the pitch characteristics of each of the notes is affected by the vibrational forces playing against the air column contained within the instrument. For example, where the player increases the force of air entering into the instrument from the mouthpiece for added volume, such that the column of air within the instrument is drastically interfered with, the pitch and tone characteristics of the notes being played are adversely affected. It is therefore desirable to smooth out the vibrational pulse rate of the air as it passes from the mouthpiece into the instrument in order to eliminate the interference with the air column in the instrument, thereby to permit the player to have a greater degree of control over the pitch and tone characteristics of the notes.

With respect to the mouthpiece 10 of the present invention, it has been found that by providing a wind compression chamber 42 located in the path of the wind channel 40, and at a point adjacent to the tip end 14 of the mouthpiece 10, the vibrational pulse rates of the air being forced through the mouthpiece 10 by the operator when the instrument is played is smoothed out such that the air entering into the instrument will not seriously interefere with or disrupt the air column contained within the instrument. Hence, the provision of a wind compression chamber 42 has been found to have superior characteristics with regard to the pitch and tone of the instrument.

In terms of dimensions, it has been found that the wind channel 40 has a certain diameter 39 (FIG. 3), and that the provision of the curvilinear flanges 26 and 28, in combination with the thickened portion 38 should reduce the diameter 39 of the wind channel 40 by between 25% and 50% of that dimension. Hence, it is contemplated that the diameter of the wind compression chamber 42 will be anywhere between 25% and 50% of the overall diameter 39 of the wind channel 40. It is further important that the overall length of the wind compression channel 42 be relatively short for the reason that it is necessary to have the wind channel 40 expand beyond the wind compression chamber 42 in order to accomplish the smoothing out characteristic of the vibrational pulse rate of the air as it passes through the wind channel 40. Hence, the overall length of the wind compression chamber 42 does not exceed the length of the curvilinear flanges 26 and 28 when taken in comparison with the overall length of the slotted cut-out section 20.

A further important feature relating to the curvilinear flanges 26 and 28 is the fact that as shown in FIG. 1 of the drawings, the flanges 26 and 28 will lend further support for the reed which is typically laid on the horizontally flattened section 18 in a manner customarily known in the art. It is known that when the operator plays the instrument by blowing air through the mouthpiece 10, the reed will vibrate against the mouthpiece and it is the vibrational rate of the reed which also has an effect on the playing of the instrument. It has been found, however, that in a typical mouthpiece of the type generally known, as the reed vibrates and slaps down against the horizontally flattened section 18, the reed tends to concave into the wind channel 40 thereby causing permanent deformation of the reed with usage. It is for this reason that a wind player is obligated to change reeds frequently since the concavity of the reed will have an adverse effect upon the ability to play certain notes, and even more importantly, has an adverse effect on tone and pitch. It will be observed that by providing the curvilinear flanges 26 and 28, additional support is provided for the reed, and this will prevent the reed from concaving through the slotted cut-out section 20 into the wind channel 40. The concomitant result is that this structure, that is the provision of the curvilinear flanges 26 and 28, forces only the tip end of the reed to vibrate and prevents the reed from concaving through the slotted cut-out section 20 into the wind channel 40, and requires that the reed vibrate basically at the tip end thereof. This has been found to be extremely desirable since this sets up a proper reed vibration which has a direct and immediate effect on improving the tonal quality of the notes being played.

Hence, it will be appreciated that by providing the curvilinear flanges 26 and 28, along the side edges 21 and 23 of the slotted cut-out section 20, the structure creates the wind compression chamber 42, as well as providing additional support for the reed when mounted on the mouthpiece 10, both of which have an improving effect on the tonal and pitch characteristics of the notes being played. It will be observed that these structures, including the curvilinear flanges 26 and 28, as well as the thickened portion 38 formed in the undersurface 36 of the inclined portion 16 of the mouthpiece 10 positioned adjacent to tip end 14 of the mouthpiece 10 as illustrated. The importance of this structure resides in the fact that the front chamber of the mouthpiece 10 is the ultimate deciding factor as to how the instrument will sound especially in tonal qualities and pitch since the various notes which can be played, and the tone and pitch characteristics thereof, are basically decided at the tip end of the mouthpiece 10 in and about the region where the reed will vibrate. It is therefore desirable to create the mouthpiece having the curvilinear flanges 26 and 28 as well as the thickened portion 38 adjacent to the tip end 14 of the mouthpiece 10 as illustrated.

With specific reference to FIG. 6 of the drawings, it will be observed that as opposed to providing distinct curvilinear flanges 26 and 28 as described, the structure may be formed in terms of thickened sections 46 and 48 respectively which are chamfered from top to bottom. Hence, as opposed to having squared off corners forming the confines of the wind compression chamber 42, the wind compression chamber 42 will simply have a more rounded off configuration as illustrated in FIG. 6.

It will be appreciated that in accordance with the above description, the present invention provides an improved mouthpiece construction which includes a pair of curvilinear flanges carried along the side edges of the slotted cut-out section for a woodwind mouthpiece in the manner indicated. In addition, the present invention provides a thickened section along the undersurface of the roof of the mouthpiece at a point adjacent to the curvilinear flanges, such that the diameter of the wind channel is reduced at that point thereby to create a wind compression chamber adjacent to the tip end of the mouthpiece. As indicated previously, the creation of a wind compression chamber has the effect of causing back pressure working against the path of travel of air as it enters into the mouthpiece, which ultimately has the effect of smoothing out the vibrational pulse rate of air as it passes through the mouthpiece and into the instrument thereby to create better tonal and pitch characteristics of the notes being played. In addition, the provision of the curvilinear flanges along the slotted cut-out section of the mouthpiece provides additional support for the side edges of the reed mounted thereon thereby forcing the reed to vibrate substantially only at the tip end thereof in order to provide the operator with better control over both tone and pitch of the notes being played. Hence, it will be observed that in accordance with the invention as described and claimed hereinafter, all of the above-named objects and advantages have been accomplished as well as additional objects and advantages as will be understood to those skilled in the art.

While there has been described what is considered to be at present the preferred embodiment of the invention, it will be understood that various modifications may be made therein and it is intended to cover in the appended claims all such modifications as fall within the true spirit and scope of the invention.

I claim:

1. An improved mouthpiece for a woodwind instrument of the type which generally includes a collar end for engaging an instrument neck at one end and a mouth engaging portion at the opposed end thereof extending from the tip end of the mouthpiece inwardly for a distance in the direction of the opposed collar end, the mouth engaging portion having an upper inclined surface along the top portion thereof and a horizontally flattened surface along the lower portion thereof, and a wind channel traversing the entire length of said mouthpiece, the improvement comprising in combination, a slotted cut-out section bounded by opposed side edges formed in said horizontally flattened surface along the lower portion thereof, said slotted cut-out section extending from the tip end of said mouthpiece inwardly for a distance in the direction of said collar end of said mouthpiece and terminating in a circular inner end, said slotted cut-out section having a key-slot configuration formed by a pair of opposed curvilinear flanges extending inwardly from the opposed side edges thereof for a portion of the distance between said tip end and said circular inner end thereof, said curvilinear flanges having a thickness which is less than the diameter of said wind channel thereby to create a wind compression chamber formed in said wind channel and extending for a distance along the length of said wind channel, whereby said wind compression chamber formed by said opposed curvilinear flanges formed in said slotted cut-out section will operate to create back pressure and have the effect of smoothing out the vibrational rate of the air as it enters the instrument thereby to improve the tonal qualities of the instrument throughout the entire tonal range thereof.

2. The improved mouthpiece as set forth in claim 1 above, wherein said slotted cut-out section has a length which extends from said tip end of the mouthpiece inwardly for approximately 40% or less, of the overall length of the said mouthpiece.

3. The improved mouthpiece as set forth in claim 1 above, wherein said curvilinear flanges have a thickness sufficient to reduce the overall diameter of said wind channel by between 25% and 50% thereof, and extend for a distance of approximately 60% of the length of said slotted cut-out section inwardly from the tip end thereof.

4. The improved mouthpiece as set forth in claim 3 above, wherein said curvilinear flanges commence at a point spaced inwardly from said tip end measuring approximately 1/6th of the overall length of said slotted cut-out section, and terminate at a point spaced from said circular end of said cut-out section measuring approximately 1/6th of the overall length of said slotted cut-out section.

5. The improved mouthpiece as set forth in claim 1 above, wherein said inclined surface positioned along the top portion of said mouthpiece includes an undersurface which forms the roof of said wind channel, said roof having a thickened portion extending over said curvilinear flanges, which together with said curvilinear flanges combine to create a wind compression chamber which has a diameter of between 25% and 50% less than the diameter of said wind channel.

* * * * *